US005135281A

United States Patent [19]

Pappalardo

[11] Patent Number: 5,135,281

[45] Date of Patent: Aug. 4, 1992

[54] SUNSHADE

[76] Inventor: Edward Pappalardo, 37 Garden Dr., Albertson, N.Y. 11507

[21] Appl. No.: 723,051

[22] Filed: Jun. 28, 1991

[51] Int. Cl.[5] ..... A47C 7/62

[52] U.S. Cl. ..... 297/184; 135/90

[58] Field of Search ..... 297/184; 135/90, 96, 135/102, 103, 106

[56] References Cited

U.S. PATENT DOCUMENTS

| | | | |
|---|---|---|---|
| 725,348 | 4/1903 | Mann | 297/184 X |
| 793,673 | 7/1905 | Mann . | |
| 2,109,881 | 1/1938 | Goldberg . | |
| 2,166,832 | 7/1939 | Wenker . | |
| 3,879,086 | 4/1975 | Moceri . | |
| 4,030,748 | 6/1977 | Brock . | |
| 4,082,102 | 4/1978 | Heuer | 297/184 X |
| 4,295,481 | 10/1981 | Gee | 297/184 X |
| 4,784,433 | 11/1988 | Purnell-Ayres . | |
| 4,810,030 | 3/1989 | Lewis . | |
| 4,813,739 | 3/1989 | Miller . | |
| 5,007,674 | 4/1991 | Franc . | |

FOREIGN PATENT DOCUMENTS

| | | | |
|---|---|---|---|
| 2437182 | 5/1980 | France | 297/184 |

*Primary Examiner*—Laurie K. Cranmer
*Attorney, Agent, or Firm*—Nolte, Nolte and Hunter

[57] ABSTRACT

This invention relates to chair sunshades, especially to chair sunshades where the sunshade is intended to be collapsible and detachable from its frame, and is made of a disposable, replaceable, and imprintable type of material.

17 Claims, 3 Drawing Sheets

SUNSHADE

BACKGROUND OF THE INVENTION

My invention in a sunshade is simpler and has more novel uses than any existing sunshade for chairs. Typical of prior art attempts will be seen in the U.S. Pat. No. 793,673 to F.T.B. Mann which discloses a folding chair with an integral shade. Other such constructions are shown in Moceri, U.S. Pat. No. 3,879,086; and Goldberg, U.S. Pat. No. 2,109,881. Portable, one purpose, attachment shades are disclosed in Miller, U.S. Pat. No. 4,813,739; Franc, U.S. Pat. No. 5,007,674; Wenker, U.S. Pat. No. 2,166,832; Lewis, U.S. Pat. No. 4,810,030; and Purnell-Ayers, U.S. Pat. No. 4,784,433.

My sunshade is of a universally adjustable design which will fit onto any folding type of lounge chair. It is also disposable and made of the simplest parts as to offer sun protection to the mass public at the lowest cost.

OBJECTS OF THE INVENTION

It is an object of this invention to provide a frame used to secure a collapsible, disposable, and replaceable sunshade made of such material that will accept the imprint of a design or text.

It is a further object of this invention to provide a sunshade and frame that is universally adjustable to most folding type lounge chairs without complicated hardware.

It is a further object of this invention that it be extremely portable in that it folds in and upon itself to fit inside a small long envelope.

It is a further object of this invention that it be adjustable as to its length so as to protect the back and shoulders when fully unfolded, or to be short folded to just shade the head and face.

It is a further object of this invention that its cost of manufacture be low enough that it may be given out in large quantity as a promotional item or sold as an inexpensive novelty item that will offer instant sun protection without the use of sunblocks or material cover-ups.

My sunshade comprises two plastic strips that form an arch by the use of two cords. These cords may use plastic washers to set and secure the plastic strips to the sunshade material. These plastic strips are anchored to the back of a chair, or other type of frame where a chair is not required, by the use of hook and loop fastener strips such as are sold under the trademarks Velcro and Scotchmate.

DETAILED DESCRIPTION

Figure 1:
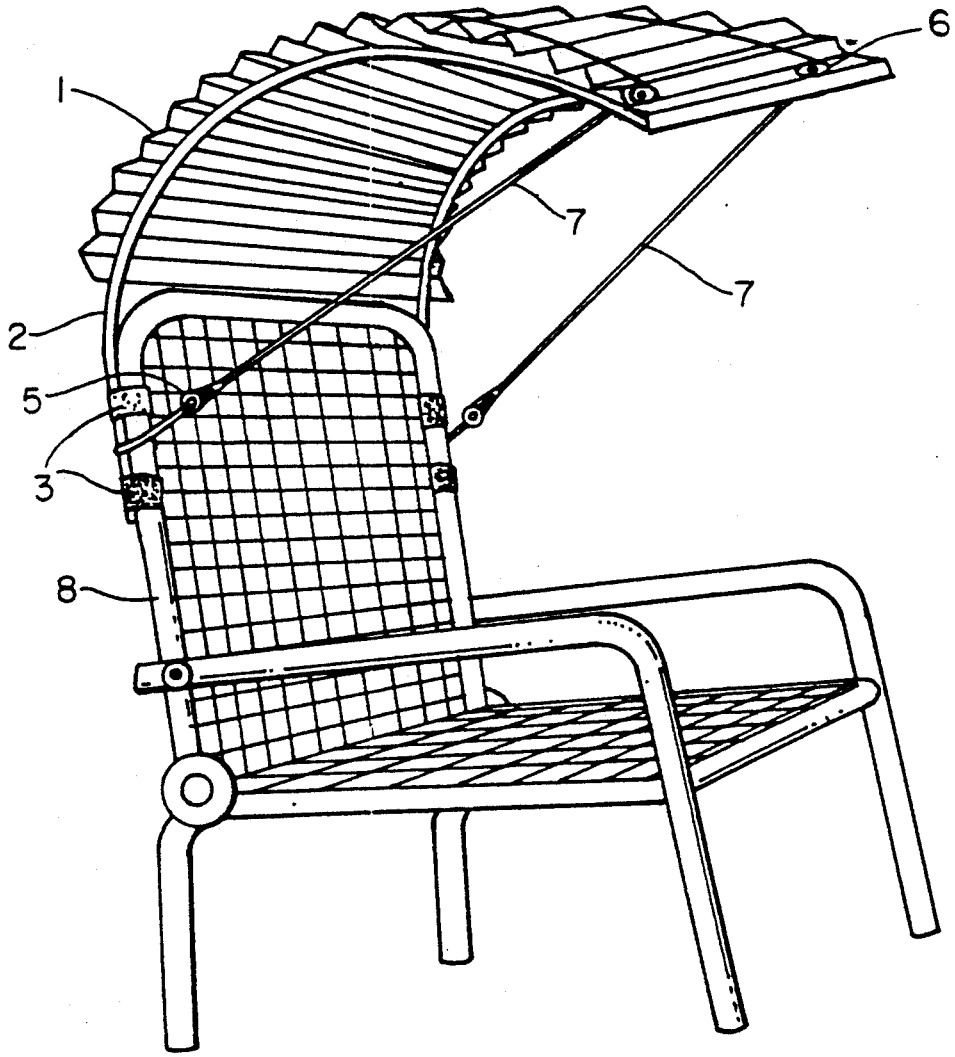
FIG. 1 is a perspective view of a chair fitted with the attachable/detachable shade of the invention.
Figure 2:
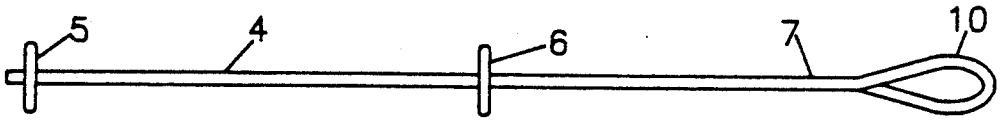
FIG. 2 is a plan view of a cord adapted for use in the shade of FIG. 1.

As seen in FIGS. 1 and 2, plastic strips 2 are attached by their base ends to the vertical frame supports on the back of a chair with hook and loop fastener strips 3.

Plastic washers 5 are connected to the end of a portion 4 of the cord shown in FIG. 2. The cord is affixed to the base of the plastic strip at the area between the two hook and loop fastener strips. The cord is brought over the top of the shade 1 (shown as an accordian-pleated shade element in FIGS. 1 and 6) and the looped ends 10 of the cords 7 are passed through slits in the front of the shade 1 and threaded through holes **7*h* (shown in FIG. 7**) in the distal ends of the plastic strips.

The looped ends 10 are pulled back to the chair frame and locked around the plastic washers 5 thereby creating an arch and retaining the sunshade by sandwiching it between each cord 4 and its associated strip. Slots in the sunshade anchor it to the distal ends of the strips where the cord passes through. Stop washers 6 determine the degree of arching.

The sunshade may be adjusted by folding its rear portion in and upon itself or by adjusting the cord lengths.

Figure 3:
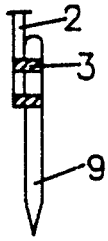
FIG. 3 is a diagramatic side view of a spike fitted with a strip of the invention, eliminating the need for a chair.

As seen in FIG. 3, plastic sand/grass spikes 9 can be used as accessories, and the need for a chair eliminated. The sunshade can be of multiple widths by the addition of parallel supports and strips.

Figure 4:
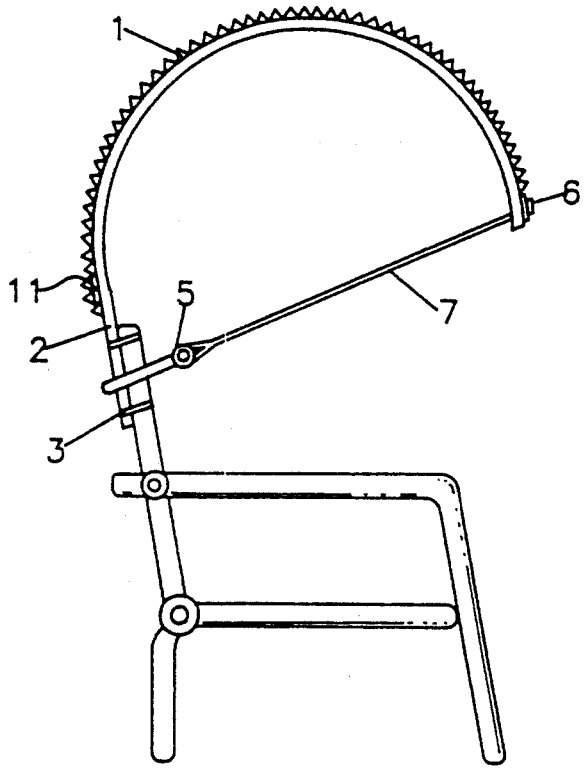
FIG. 4 is a side plan view of a variation of the invention.
Figure 5:
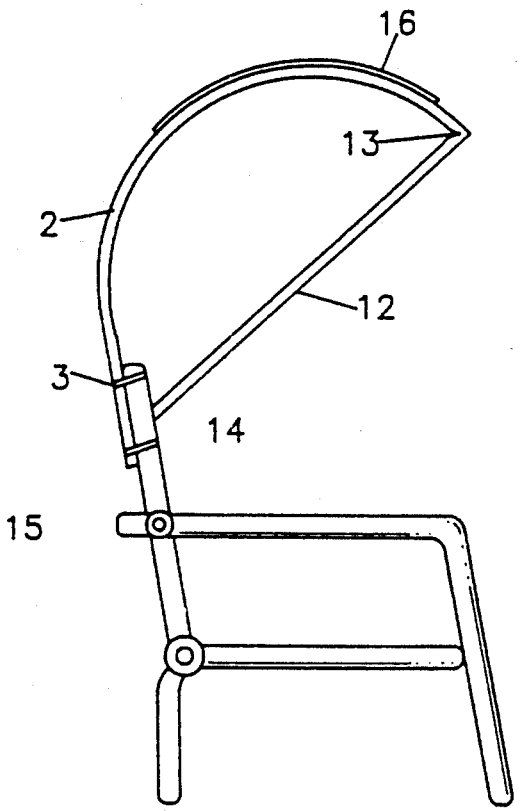
FIG. 5 is a side plan view of a second embodiment of the invention.

FIGS. 4 and 5 depict additional embodiments of the invention. In FIG. 4 washer 5 is connected directly to the base end of the plastic strip 2 and string portion 4 is eliminated. Here the string 7 is attached directly to the distal end of plastic strip and looped around the washer 5. Shade 1, here depicted as a flat piece, is anchored to the distal ends of the strips by string 7 and washer 6, the rear end of the shade is attached to the plastic strips with hook and loop fastener patcher 11.

FIG. 5 shows an embodiment where the plastic strips 2 are longer than in the previous embodiments and capable of being snapped about a weakened point 13 such as to bend and to create a portion of plastic strip 12 with a string 15 passing through a hole 14 for attachment to the base end of the strips. The shade (not shown) may be attached to the plastic strip via Velcro strips 16.

Figure 6:
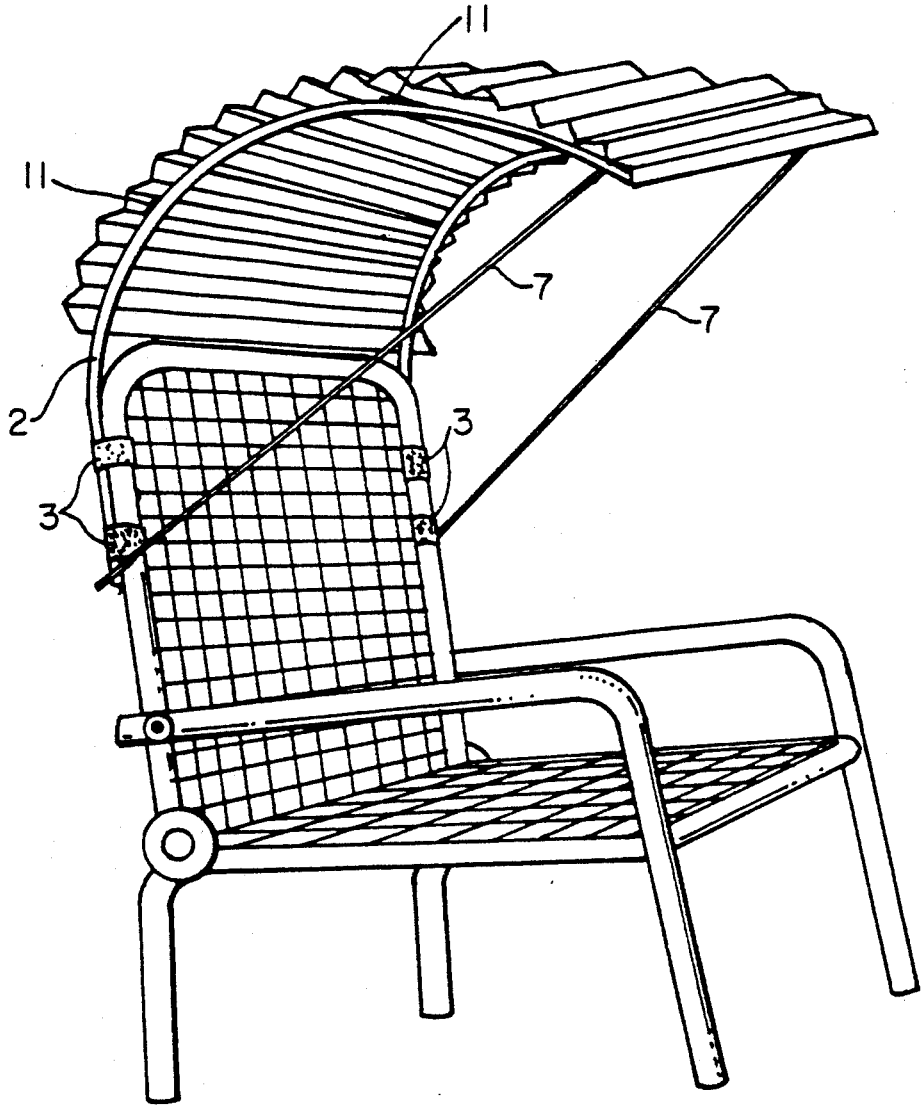
FIG. 6 is a perspective view of the simplest embodiment of the invention.
Figure 7:
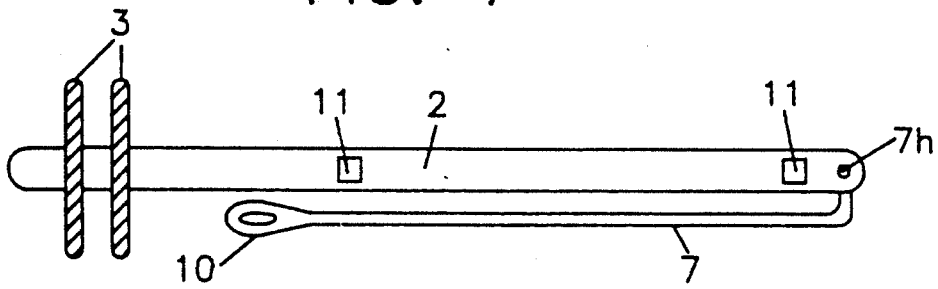
FIG. 7 shows a top plan view of one of the plastic strip assemblies used in the embodiment of the invention shown in FIG. 6.

FIGS. 6 and 7 show the simplest and least expensive embodiment of the invention. FIG. 7 shows the strip 2 and a single hole to the distal end in which string 7 is attached with a simple knot. Velcro patches 11 are affixed at the distal end and toward the base of strip 2. Again, the strip is attached to the vertical supports of the chair with Velcro strips 3 and loop 10 is pulled down and looped under the base end of the plastic strip. The shade is then attached to the top using Velcro patches 11.

As can now be appreciated, the combination of a collapsible, semi-disposable sunshade, that can be used also as a promotional device; e.g., to include print such as shown on the front of the shade 1 in FIG. 1, and will offer sun protection at a low or no cost basis to the general public. It is very simple to set up so as to encourage its use and offer the ease of portability.

The strips used to support the sunshade can be made also in rod or tube form of the following materials in addition to plastics:

1. fiberglass
2. rubber
3. wood 4. metal
5. composites

Cords can be made of the following materials in addition to simple string:

1. fiberglass
2. rubber
3. wood
4. chain
5. wire
6. composites

The sunshade can be a flat piece or pleated or a series of slats hingedly joined along adjacent sides and made of the following materials:

1. cardboard
2. paper
3. straw
4. plastic
5. screen metal
6. reflective foil
7. composites
8. any medium which is foldable and accepts print.

The invention is to be restricted only by the following claims.

I claim:

1. A sunshade comprising:
a plurality of flexible and resilient strips,
a sheet of flexible material,
means for anchoring a base end of each said strip to a support structure,
a plurality of arching cords extending between said support structure and a distal end of each said strip, means for removeable attachment of said arching cords between said support structure and said distal ends of said strips such as to cause said strips to assume an arched configuration in resilient resistance to said attachment means,
means for anchoring an edge of said sheet to said distal ends of said strips,
means for retaining said sheet draped in an arched configuration over said strips, said retaining means comprising:
a plurality of retention cords attached to the distal ends of at least two outermost strips and running atop of said sheet to the base end of said strips such that said sheet is sandwiched between each said retention cord and said strip associated therewith.

2. The invention of claim 1 wherein the support structure comprises the back of a chair.

3. The invention of claim 1 wherein the support structure comprises a plurality of spikes.

4. The invention of claim 1 wherein each said retention cord is continuous with the arching cord associated with each said strip to which each said retention cord is associated.

5. The invention of claim 4 wherein each said continuous cord further comprises:
a loop at a firs end,
means for receiving the loop at a second end,
stop means for allowing the first end to be passed through an opening in the distal end of a said strip and pulled through until said stop means comes in contact with said strip.

6. The invention of claim 1 wherein said sheet is of a material readily capable of receiving print.

7. A sunshade comprising:
a plurality of flexible and resilient strips,
means for removably anchoring a base end of each said strip to a support structure,
a plurality of cords,
means for attachment of said plurality of cords between said support structure and a distal end of each said strip such as to cause said strips to assume an arched configuration in resilient resistance to said means for attachment,
a sheet of material,
means for retaining said sheet of material draped in an arched configuration over said strips, said sheet of material comprising the sole means for rigidly keeping said strips in fixed positions relative to one another.

8. The invention of claim 7 wherein the support structure comprises the back of a chair.

9. The invention of claim 7 wherein the support structure comprises a plurality of spikes.

10. The invention of claim 7 wherein said sheet is of a material readily capable of receiving print.

11. The invention of claim 10 wherein said sheet is imprinted with a promotional message.

12. The invention of claim 7 wherein said sheet of material is from the group consisting of cardboard, paper, straw, plastic, metal and composites.

13. The invention of claim 7 wherein said sheet is corrugated.

14. A sunshade comprising:
a plurality of flexible and resilient strips,
means for removably anchoring a base end of each said strip to a support structure,
means for attachment between said support structure and a distal end of each said strip such as to cause said strips to assume an arched configuration in resilient resistance to said means for attachment,
said means for attachment comprising a continuous extended portion on at least two outermost of said strips, hingedly attached thereto, and having means for attachment to said support structure, means for retaining a sheet of material draped in an arched configuration over said strips, said material comprising means for rigidly keeping said strips a fixed distance apart.

15. The invention of claim 14 wherein the support structure comprises the back of a chair.

16. The invention of claim 14 wherein the support structure comprises a plurality of spikes.

17. The invention of claim 14 wherein said sheet is of a material readily capable of receiving print.

* * * * *